US011732865B2

(12) United States Patent
Lenzen et al.

(10) Patent No.: US 11,732,865 B2
(45) Date of Patent: Aug. 22, 2023

(54) LED MODULE, LED MODULE AND REFLECTOR ARRANGEMENT, AND VEHICLE HEADLAMP

(71) Applicant: LUMILEDS LLC, San Jose, CA (US)

(72) Inventors: Thorsten Lenzen, Aachen (DE); Joseph Hendrik Anna Maria Jacobs, Eygelshoven (NL); Matthias Holtrup, Aachen (DE); Marc Droegeler, Aachen (DE); Frank Giese, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 17/670,019

(22) Filed: Feb. 11, 2022

(65) Prior Publication Data

US 2022/0260229 A1 Aug. 18, 2022

Related U.S. Application Data

(60) Provisional application No. 63/148,997, filed on Feb. 12, 2021.

(51) Int. Cl.

| | |
|---|---|
| ***F21S 45/47*** | (2018.01) |
| ***F21S 41/37*** | (2018.01) |
| ***F21S 41/143*** | (2018.01) |

(52) U.S. Cl.

CPC ..... *F21S 45/47* (2018.01); *F21S 41/143* (2018.01); *F21S 41/37* (2018.01)

(58) Field of Classification Search

CPC ..... F21S 41/36; F21S 41/365; F21S 43/33; F21S 43/50; F21S 41/37; F21S 41/50; F21V 9/08; F21V 9/02

See application file for complete search history.

(56) References Cited

U.S. PATENT DOCUMENTS 1,954,010 A * 4/1934 Koubek ..... B60Q 1/2607 362/540

2007/0258153 A1* 11/2007 Martynov ..... F21S 43/14 359/726

FOREIGN PATENT DOCUMENTS

EP 2824383 A1 * 1/2015 ..... F21S 48/1225

* cited by examiner

*Primary Examiner* — Omar Rojas Cadima

(74) *Attorney, Agent, or Firm* — Volpe Koenig

(57) ABSTRACT

An LED module includes a heat sink. The heat sink has a mounting surface that defines, with respect to ambient light incident thereon, one main direction of a beam perpendicular to the mounting surface and secondary directions of the beam inclined to the main direction of the beam at angles having absolute values smaller than or equal to 90 degrees. The heat sink also has a reflection surface oriented such that, with respect to the ambient light incident on thereon, a main direction of the beam of the reflection surface is perpendicular to the reflection surface and points in a direction included in the angle range determined by the main direction of the beam of the mounting surface and the secondary directions of the beam of the mounting surface. The LED module further includes an LED light source on the mounting face and pigments on the reflection surface.

20 Claims, 3 Drawing Sheets

LED MODULE, LED MODULE AND REFLECTOR ARRANGEMENT, AND VEHICLE HEADLAMP

CROSS REFERENCE TO RELATED APPLICATIONS

This application claims the benefit of U.S. Provisional Patent Application No. 63/148,997, which was filed on Feb. 12, 2021, the contents of which are hereby incorporated by reference herein.

BACKGROUND

Light emitting diodes (LEDs) are rapidly gaining popularity because of their longevity and low energy credentials. Advances in manufacturing have led to the emergence of chip-sized LED packages or modules in which at least one LED as a single light source, and typically multiple LEDs as one combined light source, are packaged together, for example in a matrix-like manner comprising multiple rows in which multiple LEDs may be arranged, respectively. Application domains for such LED modules include, but are not limited to, automotive front lighting, such as vehicle headlamps.

SUMMARY

An LED module includes a heat sink. The heat sink has a mounting surface that defines, with respect to ambient light incident thereon, one main direction of a beam perpendicular to the mounting surface and secondary directions of the beam inclined to the main direction of the beam at angles having absolute values smaller than or equal to 90 degrees. The heat sink also has a reflection surface oriented such that, with respect to the ambient light incident on thereon, a main direction of the beam of the reflection surface is perpendicular to the reflection surface and points in a direction included in the angle range determined by the main direction of the beam of the mounting surface and the secondary directions of the beam of the mounting surface. The LED module further includes an LED light source on the mounting face and pigments on the reflection surface.

BRIEF DESCRIPTION OF THE DRAWINGS

A more detailed understanding can be had from the following description, given by way of example in conjunction with the accompanying drawings wherein.

DETAILED DESCRIPTION

Figure 1:
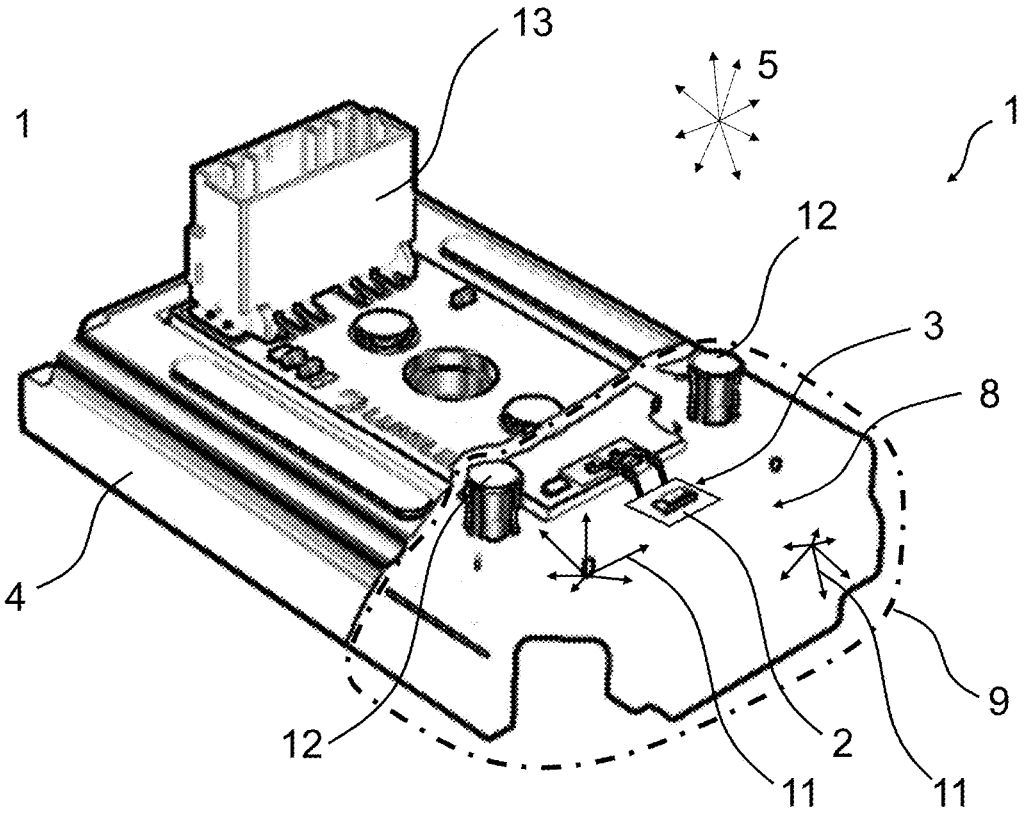
FIG. 1 is a perspective oblique view of an exemplary embodiment of an LED module.

Examples of different light illumination systems and/or light emitting diode ("LED") implementations will be described more fully hereinafter with reference to the accompanying drawings. These examples are not mutually exclusive, and features found in one example may be combined with features found in one or more other examples to achieve additional implementations. Accordingly, it will be understood that the examples shown in the accompanying drawings are provided for illustrative purposes only and they are not intended to limit the disclosure in any way. Like numbers refer to like elements throughout.

It will be understood that, although the terms first, second, third, etc. may be used herein to describe various elements, these elements should not be limited by these terms. These terms may be used to distinguish one element from another. For example, a first element may be termed a second element and a second element may be termed a first element without departing from the scope of the present invention. As used herein, the term "and/or" may include any and all combinations of one or more of the associated listed items.

It will be understood that when an element such as a layer, region, or substrate is referred to as being "on" or extending "onto" another element, it may be directly on or extend directly onto the other element or intervening elements may also be present. In contrast, when an element is referred to as being "directly on" or extending "directly onto" another element, there may be no intervening elements present. It will also be understood that when an element is referred to as being "connected" or "coupled" to another element, it may be directly connected or coupled to the other element and/or connected or coupled to the other element via one or more intervening elements. In contrast, when an element is referred to as being "directly connected" or "directly coupled" to another element, there are no intervening elements present between the element and the other element. It will be understood that these terms are intended to encompass different orientations of the element in addition to any orientation depicted in the figures.

Relative terms such as "below," "above," "upper,", "lower," "horizontal" or "vertical" may be used herein to describe a relationship of one element, layer, or region to another element, layer, or region as illustrated in the figures. It will be understood that these terms are intended to encompass different orientations of the device in addition to the orientation depicted in the figures.

In a vehicle headlamp, the LED module may be arranged in combination with a reflector, which may reflect the light generated by the LED module towards an outside of the vehicle headlamp. Heat generated during operation of the LED light source of the LED module may be dissipated by a heat sink of the LED module. The LED module comprising the LED light source and the heat sink may be arranged in close proximity to the reflector. Accordingly, it is possible that ambient light (e.g., daylight) that enters the vehicle headlamp from an outside will be reflected by the reflector and the heat sink, which may render the heat sink visible to a human eye of an observer outside of (e.g., distant to) a vehicle comprising the vehicle headlamp. Such a visual impression may be perceived as unattractive and may, therefore, be undesirable.

Accordingly, there may be a need for a LED module, an arrangement of an LED module and a reflector, and a vehicle headlamp that have an improved attractiveness along with high performance, where performance may be assessed, inter alia, on the qualities of illumination performance, installation ease and set-up time, and manufacturing ease and cost.

FIG. 1 is a perspective oblique view of an exemplary embodiment of an LED module 1. The LED module 1 may be used in a vehicle headlamp as shown, for example, in FIGS. 5 and 6 and described below (without being limited thereto). In the example illustrated in FIG. 1, the LED module 1 includes an LED light source 2, such as one or more individual LEDs arranged on a PCB as one LED light source, for generating light. In the example illustrated in FIG. 1, the LED light source 2 is a top contact LED light source directly mounted on a mounting surface 3 of a heat sink 4 for dissipating heat generated by the LED light source 2 when being operated (e.g., when generating light).

Figure 3:
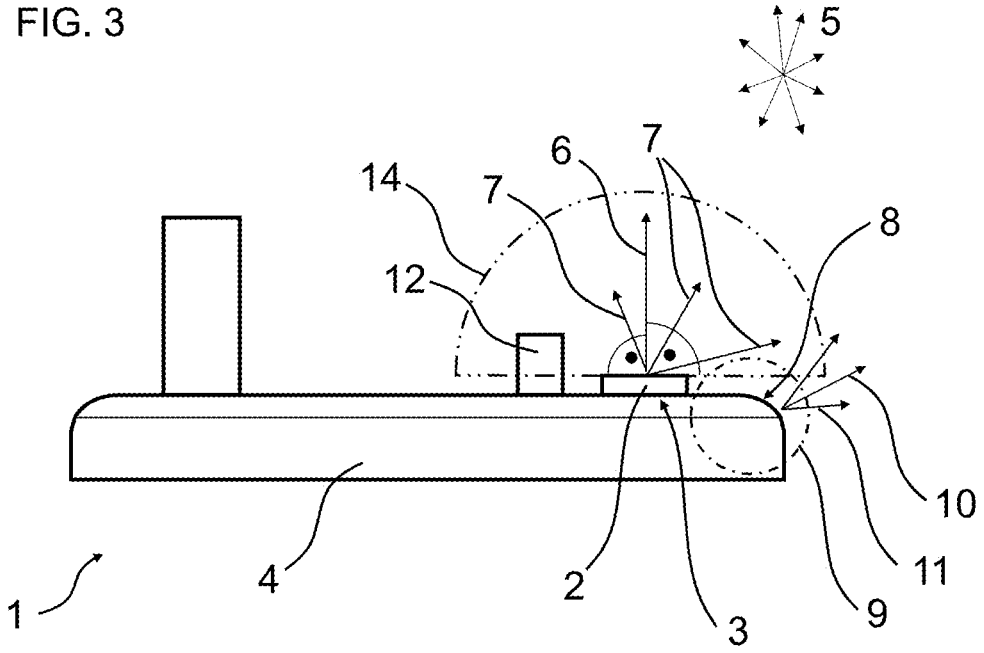
FIG. 3 is a side view of the example LED module of FIG. 1.

Hereinafter, reference will be made in an alternating fashion to FIGS. 1 and 3, wherein FIG. 3 depicts a side view of the LED module 1 of FIG. 1.

FIG. 3 illustrates that, with respect to ambient light 5, such as daylight, incident on the mounting surface 3, the mounting surface 3 may define one main direction of beam 6 being perpendicular thereto and secondary directions of beam 7 being inclined to the main direction of beam 6 at angles having absolute values smaller than or equal to 90 degrees. The main direction of beam 6 may also be referred to as a surface normal of the mounting surface 2. The surface normal may point essentially in the direction in which the light generated by the LED light source when mounted on the mounting surface is emitted.

Furthermore, pigments 8 of at least one color (e.g., a colored material) may be applied to a reflection surface 9 of the heat sink 4. The reflection surface 9 may be oriented such that, with respect to the ambient light 5 incident on the reflection surface 9, a main direction of beam 10 of the reflection surface 9 perpendicular thereto points in a direction included in the angle range determined by the main direction of beam 6 of the mounting surface 3 and the secondary directions of beam 7 of the mounting surface 3 (e.g., being included in the hemisphere described below). In FIG. 3, one main direction of the beam of the reflection surface 9 is indicated with reference numeral 10 and secondary directions of beam of the reflection surface 9 with respect to the main direction of beam 10 thereof are indicated with reference numeral 11 by way of example.

As the colored reflection surface may reflect ambient light (e.g., daylight), at least partly in the same direction as the light generated and emitted by the LED light source when mounted to the mounting surface, it is possible to arrange the LED module in close proximity to or abutting a reflector, such as a reflector of a headlamp for a vehicle, such that the reflector reflects the ambient light (e.g., daylight) from the colored reflection surface of the heat sink towards an observer observing the headlamp from a distance, for example. If the LED light source of the LED module is not operated (e.g., no light is generated), the observer may get the impression of an at least partly colored reflector without the reflector itself being colored. In contrast, coloring the reflector itself may adversely affect its reflection performance and may likewise increase manufacturing cost and effort. Hence, the LED module according to the embodiments described herein may ensure a high illumination performance when the LED light source is operated (e.g., light is generated) while at the same time improving attractiveness to a human observer while still ensuring installation ease and set-up time as well as low manufacturing cost.

A hemisphere may be defined by the main direction of beam 6 of the mounting surface 3 and the multiple potential secondary directions of beam 7 of the mounting surface 3 as described herein and is indicated with reference numeral 14 in FIG. 3. In other words, the definition of the main direction of the beam and secondary directions of the beam as described above may form a hemisphere, which may be the result of an intersection of a plane comprising the mounting surface and a sphere, wherein the center of the hemisphere is included in the plane.

In the exemplary embodiment of the LED module 1 shown in FIG. 1, the reflection surface 9 includes the mounting surface 3 of the heat sink 4. Particularly, in the illustrated example, the reflection surface 9 completely surrounds the mounting surface 3, however, without being limited thereto.

Furthermore, in the embodiment of the LED module 1 according to FIG. 1, the heat sink 4 provides a stopper means 12, which is embodied as stopper pins in the illustrated example, for aligning the heat sink 4 to a reflector (not shown), such as a reflector of a vehicle headlamp, in one predetermined position as will be illustrated in more detail further below. In some embodiments, the stopper means may include or be stopper pins, edges, rims, borders, etc., for aligning the heat sink to the reflector in one predetermined position. Thus, proper arrangement of the LED module and the reflector may be ensured regarding both optimal visual effects as set forth herein and potential regulations to be complied with if, for example, the arrangement is used as part of a vehicle headlamp.

Also, a connector 13 may be mounted to the heat sink 4 to provide electrical current and/or a control signal to the LED light source 2, such as provided by an electronic control unit (not shown) being electrically connected to the connector 13.

From FIG. 1, it may further be observed that the pigments 8 applied to the reflection surface 9 of the LED module 1 may be uniformly distributed thereon, ensuring a homogenous appearance of the reflection surface. It is to be understood that the pigments 8 may be distributed uniformly over the entire heat sink 4 or only in the portion of the heat sink 4 delimited by the reflection surface 9 as such. In any case, the reflection surface 9 according to this embodiment may be a single-colored reflection surface having the color of the pigments distributed thereon. Such embodiments may be employed, for example, when a specific color appearance is to be conveyed by the LED module to a (e.g., distant) human observer.

According to some embodiments, the reflection surface includes at least part of the mounting surface. In other words, the reflection surface may adjoin the mounting surface to which the LED light source is mounted. As the LED light source is always visible to a reflector when arranged therewith, such as in a vehicle headlamp, the reflection surface may be visible automatically as well without having to provide additional or specific configurations to achieve the visibility of the reflection surface of the LED module, thus further simplifying the design of the LED module resulting in reduced manufacturing cost.

Figure 2:
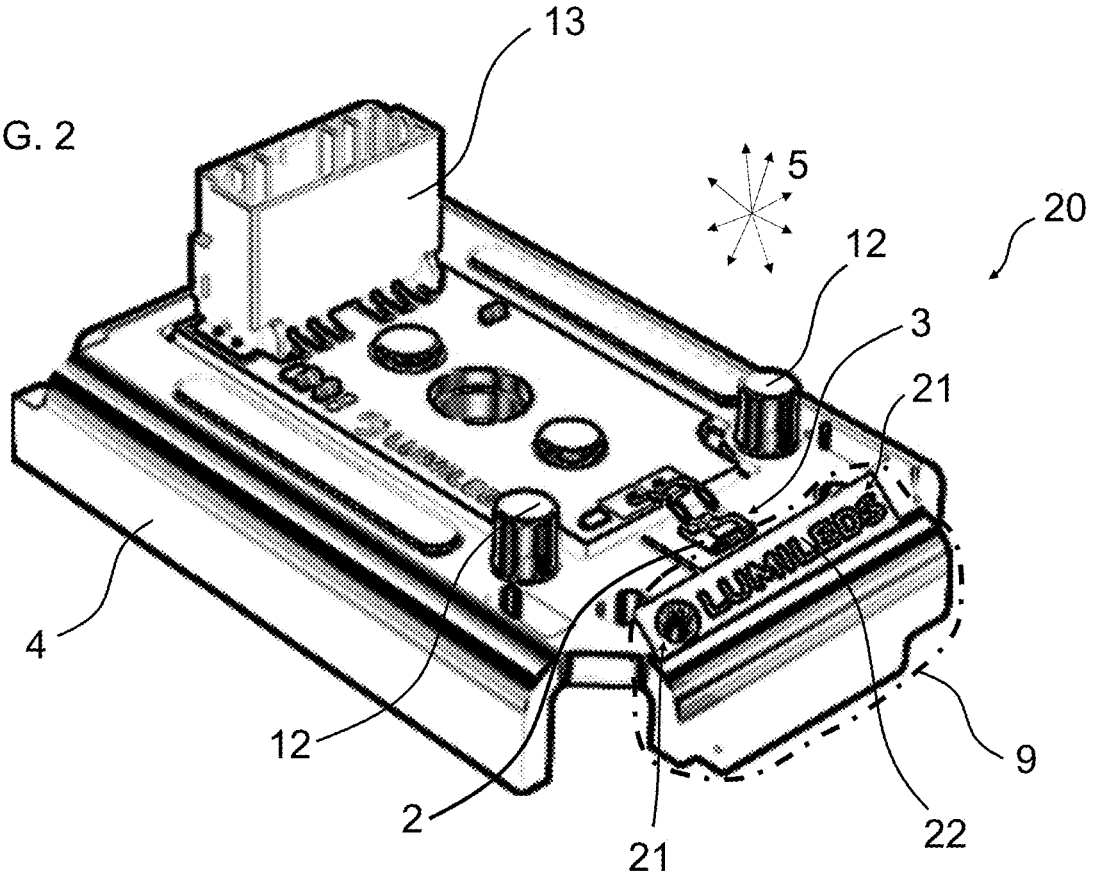
FIG. 2 is a perspective oblique view of another exemplary embodiment of an LED module.

FIG. 2 illustrates a perspective oblique view of another exemplary embodiment of a LED module 20. In the embodiment shown, colored pigments 21 are non-uniformly distributed on the reflection surface 9 of the LED module 20. Rather, the pigments 21 are disposed on the reflection surface 9 of the LED module 20 such as to create a color contrast representing a graphical symbol and/or an alphanumeric character as illustrated in FIG. 2 for example. To this end, the color contrast may be obtained between pigments 21 having only one color and the natural color of the heat sink 4 if the heat sink 4 is not entirely covered by the pigments 21 within the area of the reflection surface 9. Such embodiments may not only impart a desired color impression but additionally may facilitate to convey further information to a distant observer by creating a color contrast. For example, a logo, symbol, label, writing and the like may be applied to the reflection surface. Methods of application may be laser marking, printing, stamping and the like.

Alternatively, or additionally, the color contrast may also be obtained by disposing pigments 21 of at least two different colors on the reflection surface 9. In this case, the reflection surface 9 may be at least two-colored. A potentially visible natural color of the heat sink 4 within the area of the reflection surface 9 may add one more color to the overall color impression of the reflection surface 9.

Furthermore, as can be observed in FIG. 2, the LED module's reflection surface 9 may comprise a label 22 or label-type surface portion onto which the pigments are unevenly distributed to create the color contrast as described above. An additional advantage of this label-type surface portion 22 may be that it may be inclined independently from any configuration of the heat sink 4 to yield an even better optical projection of the information created by the pigments 21 on the reflection surface 9 onto the eyes of a distant observer.

Figure 4:
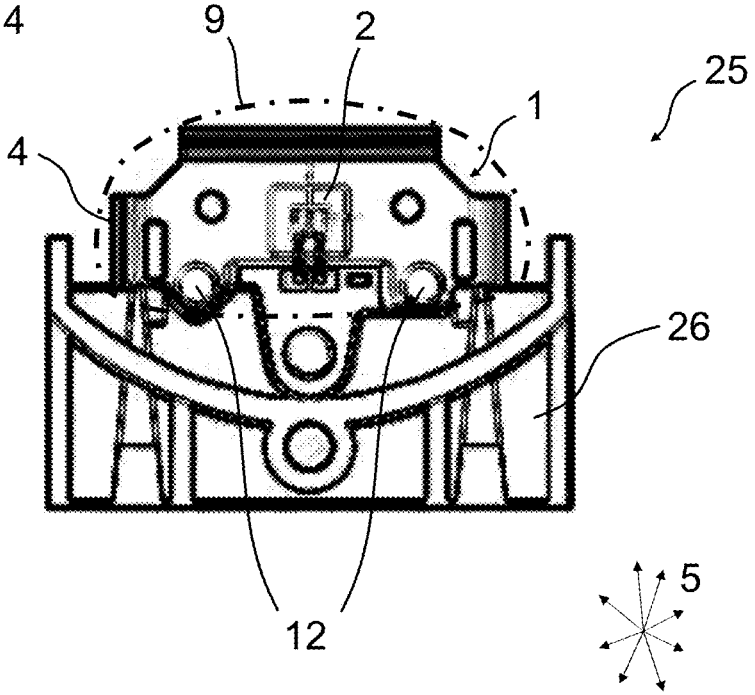
FIG. 4 is a top view of an exemplary embodiment of an arrangement of the LED module of FIG. 1 and a reflector.

FIG. 4 illustrates a top view of an exemplary embodiment of an arrangement 25 of the LED module 1 of FIG. 1 for generating light and a reflector 26 for reflecting the light generated by the LED module 1. This arrangement may be used in a vehicle headlamp, for example, as shown in the below-elucidated FIGS. 5 and 6.

It is visible in FIG. 4 that the stopper pins 12 of the LED module 1 may serve to properly arrange the LED module 1 adjacent to and abutting the reflector 26 so that the reflector 26 reflects both the light being generated by the LED light source 2 of the LED module 1 and ambient light 5 incident on the reflection surface 9 of the heat sink 4 of the LED module 1 to yield the desired optimal optical effects described herein.

Figure 5:
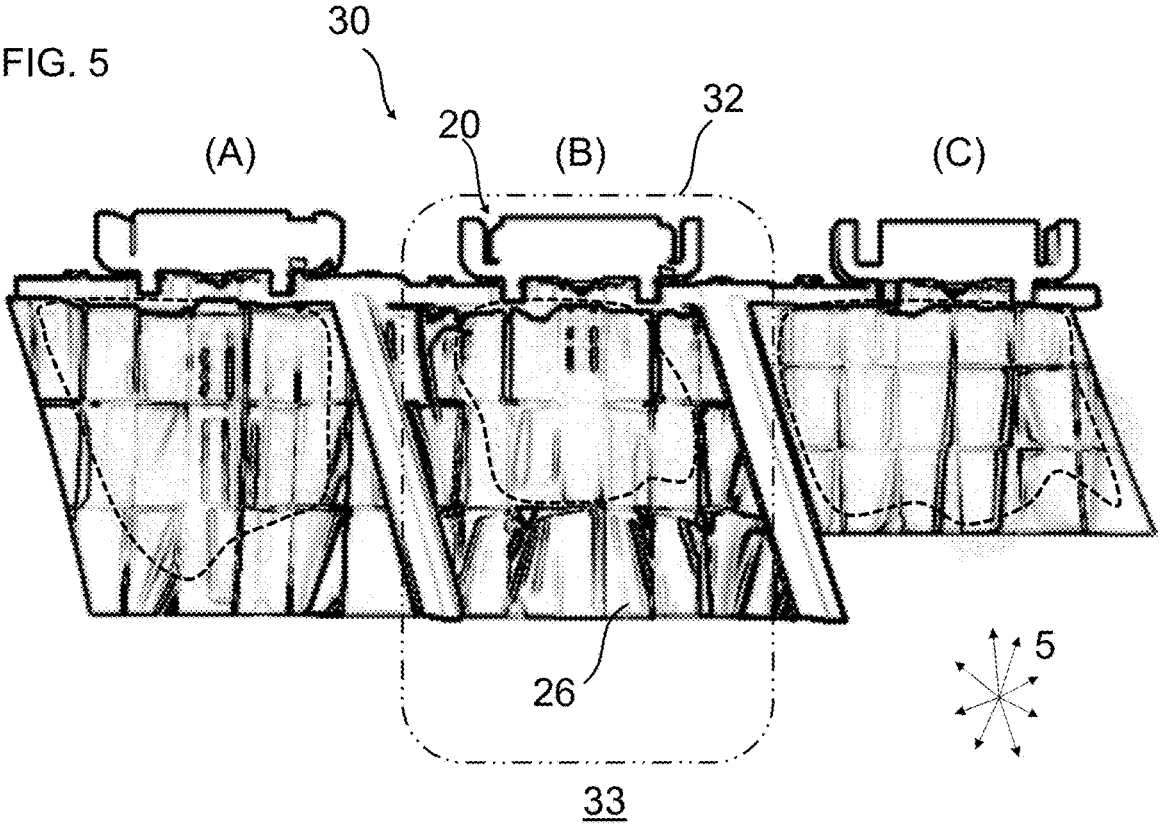
FIG. 5 shows three different top views of various exemplary embodiments of vehicle headlamps comprising the LED module of FIG. 1.

FIG. 5 shows three different top views A, B, and C of various exemplary embodiments of a vehicle headlamp 30 comprising the LED module 1 of FIG. 1.

Figure 6:
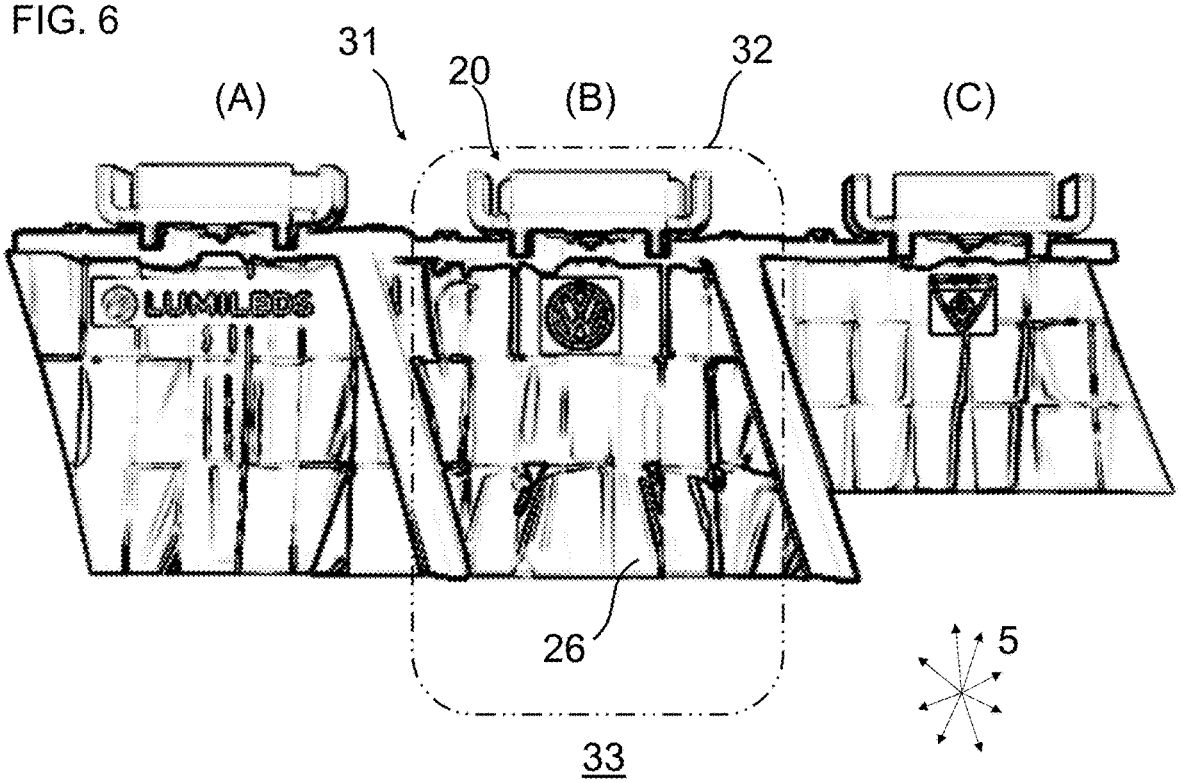
FIG. 6 shows three different top views of other various exemplary embodiments of vehicle headlamps comprising the LED module of FIG. 2.

FIG. 6 shows three different top views A, B, and C of other various exemplary embodiments of a vehicle headlamp 31 comprising the LED module 20 of FIG. 2.

The vehicle headlamps 30 and 31 may each comprise a housing 32, which is only indicated in the respective views B of FIGS. 5 and 6. The housing 32 may accommodate the LED module 1 and 20, respectively, for generating light when the respective LED light source 2 (e.g., shown in FIGS. 1 and 2) is operated. The vehicle headlamps 30 and 31 may each comprise a reflector 26 for reflecting the light generated by the LED module 1 and 20, respectively. Again, the reflector 26 is only indicated in the respective views B of FIGS. 5 and 6. As FIGS. 5 and 6 show, the LED modules 1 and 20 may each be arranged adjacent to the respective reflector 26 such that the reflector 26 reflects, towards an outside 33 of the housing 32, both the light being generated by the LED light source 2 of the LED modules 1 and 20, respectively, and ambient light 5 incident on the reflection surfaces 9 (as shown, for example, in FIGS. 1 and 2) of the heat sinks 4 of the LED modules 1 and 20, respectively.

In other words, the LED module comprising the LED light source and the heat sink may be arranged near or abutting the reflector. Ambient light, such as daylight, incident on the reflector may shine on the heat sink. The light reflected by the heat sink may then be reflected by the reflector onto a human's eye of an observer distant to the arrangement while observing it.

The essential difference between the views A, B, and C of the respective FIGS. 5 and 6 may be a varying reflection pattern of the reflection surfaces 9 created and reflected by the particular reflector 26 used in combination with the LED module 1 and 20, respectively.

It is to be emphasized that, with regard to the effects and advantages of the features regarding the arrangement of the LED module and the reflector described herein, also reference is made to the full extent to corresponding features of the LED module. Therefore, if technical meaningful and applicable, features of the LED module shall be regarded also as disclosed features for embodiments of the arrangement of the LED module and the reflector unless explicitly stated otherwise. Likewise, features of the arrangement of the LED module and the reflector shall be regarded also as features applicable to embodiments of the LED module unless explicitly stated otherwise. Hence, for the purpose of conciseness and ease of readability duplicate detailed explanations of analogous features are largely omitted or at least reduced to a minimum hereinafter without any such omissions being construed as limitations.

Having described the embodiments in detail, those skilled in the art will appreciate that, given the present description, modifications may be made to the embodiments described herein without departing from the spirit of the inventive concept. Therefore, it is not intended that the scope of the invention be limited to the specific embodiments illustrated and described.

What is claimed is:

1. A light-emitting device (LED) module comprising:

a heat sink comprising a mounting surface and a reflection surface;

pigments on the reflection surface of the heat sink; and an LED light source on the mounting surface of the heat sink, the LED light source defining, with respect to the mounting surface, one main direction of a beam perpendicular to the mounting surface and secondary directions of other beams inclined to the main direction of the beam at angles having absolute values smaller than or equal to 90 degrees, the reflection surface of the heat sink being oriented such that, with respect to ambient light incident thereon, a main direction of another beam reflected by the reflection surface is perpendicular to the reflection surface and points in a direction included in an angle range determined by the main direction of the beam and the secondary directions of the other beams.

2. The LED module as claimed in claim 1, wherein the reflection surface includes at least part of the mounting surface.

3. The LED module as claimed in claim 1, wherein the pigments are uniformly distributed on the reflection surface.

4. The LED module as claimed in claim 1, wherein the pigments are non-uniformly distributed on the reflection surface.

5. The LED module as claimed in claim 1, wherein the reflection surface is at least two-colored.

6. The LED module as claimed in claim 1, wherein the pigments comprise pigments of at least two colors on the reflection surface.

7. The LED module as claimed in claim 6, wherein the pigments represent at least one of a graphical symbol and an alphanumeric character.

8. The LED module as claimed in claim 1, wherein the reflection surface comprises a label.

9. The LED module as claimed in claim 1, wherein the reflection surface comprises a label-type surface portion.

10. An LED lighting system comprising:

an LED module comprising:

a heat sink comprising a mounting surface and a reflection surface, pigments on the reflection surface of the heat sink, and an LED light source on the mounting surface of the heat sink, the LED light source defining, with respect to the mounting surface, one main direction of a beam perpendicular to the mounting surface and secondary directions of other beams inclined to the main direction of the beam at angles having absolute values smaller than or equal to 90 degrees, the reflection surface of the heat sink being oriented such that, with respect to ambient light incident thereon, a main direction of another beam reflected by the reflection surface is perpendicular to the reflection surface and points in a direction included in an angle range determined by the main direction of the beam and the secondary directions of the other beams; and a reflector arranged adjacent to the LED module such that the reflector is configured to reflect both light generated by the LED light source of the LED module and the ambient light incident on the reflection surface of the heat sink of the LED module.

11. The system of claim 10, wherein the heat sink further comprises a stopper configured to align the heat sink to the reflector in one predetermined position.

12. The system of claim 11, wherein the stopper is at least one of a stopper pin, an edge, a rim, or a border.

13. The system of claim 10, wherein the reflection surface includes at least part of the mounting surface.

14. The system of claim 10, wherein the pigments are uniformly distributed on the reflection surface.

15. The system of claim 10, wherein the pigments are non-uniformly distributed on the reflection surface.

16. A vehicle headlamp comprising:

a housing;

a light-emitting device (LED) module accommodated in the housing, the LED module comprising:

a heat sink comprising a mounting surface and a reflection surface, pigments on the reflection surface of the heat sink, and an LED light source on the mounting surface of the heat sink, the LED light source defining, with respect to the mounting surface, one main direction of a beam perpendicular to the mounting surface and secondary directions of other beams inclined to the main direction of the beam at angles having absolute values smaller than or equal to 90 degrees, the reflection surface of the heat sink being oriented such that, with respect to ambient light incident thereon, a main direction of another beam reflected by the reflection surface is perpendicular to the reflection surface and points in a direction included in an angle range determined by the main direction of the beam and the secondary directions of the other beams; and a reflector adjacent to the LED module such that the reflector is configured to reflect, towards an outside of the housing, both light generated by the LED light source of the LED module and the ambient light incident on the reflection surface of the heat sink of the LED module.

17. The system of claim 16, wherein the heat sink further comprises a stopper configured to align the heat sink to the reflector in one predetermined position.

18. The system of claim 16, wherein the stopper is at least one of a stopper pin, an edge, a rim, or a border.

19. The system of claim 16, wherein the reflection surface includes at least part of the mounting surface.

20. The system of claim 16, wherein the pigments are uniformly distributed on the reflection surface.

* * * * *